US005191663A

United States Patent [19]

Holder et al.

[11] Patent Number: 5,191,663

[45] Date of Patent: Mar. 9, 1993

[54] HOSPITAL BED SIDEGUARD PADS

[75] Inventors: Frederick J. Holder, Shelbyville, Ind.; John W. Lannen, Salem, Va.; Raymond H. Grote, Hamilton, Ohio

[73] Assignee: Hill-Rom Company, Inc., Batesville, Ind.

[21] Appl. No.: 907,654

[22] Filed: Jul. 2, 1992

[51] Int. Cl.[5] ..... A47C 21/08

[52] U.S. Cl. ..... 5/424; 5/425

[58] Field of Search ..... 5/424, 425, 427, 663, 5/658

[56] References Cited

U.S. PATENT DOCUMENTS

| | | | |
|---|---|---|---|
| 421,656 | 2/1890 | Blanken | 5/425 |
| 993,119 | 5/1911 | Stannard . | |
| 2,071,155 | 2/1937 | Alexander | 5/426 |
| 2,254,466 | 9/1941 | Albert . | |
| 2,644,173 | 7/1953 | James . | |
| 2,710,976 | 6/1955 | Martensen . | |
| 2,951,252 | 9/1960 | Roche . | |
| 3,148,387 | 9/1964 | Sarnie, Jr. et al. . | |
| 3,266,545 | 8/1966 | Kruissink . | |
| 3,321,779 | 5/1967 | Kaufman et al. . | |
| 3,566,414 | 3/1971 | Basner . | |
| 3,610,685 | 10/1971 | Lay | 297/231 |
| 3,619,824 | 11/1971 | Doyle | 5/93.1 |
| 3,695,690 | 10/1972 | Carson | 297/218 |
| 3,742,530 | 7/1973 | Clark | 5/425 |
| 3,905,591 | 9/1975 | Schorr et al. | 5/425 |
| 4,183,015 | 1/1980 | Drew et al. | 5/425 |
| 4,214,326 | 7/1980 | Spann | 5/424 |
| 4,215,446 | 8/1980 | Mahoney | 5/425 |
| 4,232,415 | 11/1980 | Webber | 5/427 |
| 4,370,765 | 2/1983 | Webber | 5/427 |
| 4,437,704 | 3/1984 | Hovsepians | 5/490 |
| 4,607,402 | 8/1986 | Pollard | 5/425 |
| 4,654,903 | 4/1987 | Chubb et al. | 5/108 |
| 4,670,923 | 6/1987 | Gabriel | 5/424 |
| 4,672,698 | 6/1987 | Sands | 5/424 |
| 4,704,750 | 11/1987 | Wheelock | 5/127 |
| 4,710,049 | 12/1987 | Chang | 5/424 |
| 4,710,992 | 12/1987 | Falwell | 5/424 |
| 4,767,419 | 8/1988 | Fattore | 5/424 |
| 4,783,864 | 11/1988 | Turner | 5/424 |
| 4,800,600 | 1/1989 | Baum | 5/424 |
| 4,827,545 | 5/1989 | Arp | 5/424 |
| 4,872,228 | 10/1989 | Bishop | 5/425 |
| 4,873,734 | 10/1989 | Pollard | 5/425 |
| 4,932,524 | 6/1990 | Hodson | 206/320 |
| 5,010,611 | 4/1991 | Mallett | 5/424 |
| 5,035,014 | 7/1991 | Blanchard | 5/424 |
| 5,044,025 | 9/1991 | Hunsinger | 5/424 |
| 5,097,550 | 3/1992 | Marra | 5/424 |

*Primary Examiner*—Alexander Grosz

*Attorney, Agent, or Firm*—Wood, Herron & Evans

[57] ABSTRACT

A sideguard pad for use in conjunction with a hospital bed having sideguards comprising a slipcover having one compartment adapted to fit over the sideguard, and a pad disposed in another compartment of the slipcover which positions the pad inboard of the sideguard. The pad is a slab of polyurethane foam which substantially covers the vertical plane of the sideguard, and includes an upper lip which substantially covers the upper edge of the sideguard. The slipcover is fabricated of urethane coated nylon or urethane coated polyester and includes zippers for removably inserting the pad within the slip cover, and Velcro® closures for securing the sideguard pad to the sideguard. Apertures are provided in the sideguard pad for accessing hospital bed controls located on the sideguard.

6 Claims, 1 Drawing Sheet

HOSPITAL BED SIDEGUARD PADS

FIELD OF THE INVENTION

This invention relates generally to hospital beds, and more particularly to pads for the sideguards of hospital beds.

BACKGROUND OF THE INVENTION

Hospital beds in use today normally include one or more sideguards on either side of the bed for preventing a patient lying atop the hospital bed from rolling off the bed and becoming injured. These sideguards are normally fabricated of a hard material such as a rigid plastic or the like.

A criticism of such common hospital beds, however, is that the sideguards of the hospital bed are normally unpadded. Consequently, should a patient inadvertently roll into the sideguards, the patient could become bruised or sustain other injuries.

It has therefore been an objective of the present invention to devise a pad for a hospital bed sideguard which is of a simple construction and which will provide a relatively soft, resilient side padding to protect a patient who inadvertently rolls into the sideguard.

SUMMARY OF THE INVENTION

The present invention is a sideguard pad for use in conjunction with a hospital bed having sideguards comprising a slipcover forming two compartments, one of which is adapted to fit over the sideguard, and the other of which is adapted to receive a pad and which positions the pad inboard of the sideguard. The sideguard pad is operable to prevent patient injuries when contacting the sideguard.

In a presently preferred form of the invention, the pad is a slab of polyurethane foam which substantially covers the inboard vertical plane of the sideguard. The slab includes an upper lip which substantially covers the upper edge of the sideguard. The foam slab with lip thereon is thereby operable to pad the inboard plane of the sideguard as well as the upper edge of the sideguard.

The slipcover is fabricated of urethane coated nylon or urethane coated polyester, and includes zippers for removably inserting the pad within the slipcover, and fabric hook and loop closures, such as Velcro® closures, for securing the sideguard pad to the sideguard. The sideguard pad may have apertures therein for accessing hospital bed controls which are located on either side of the sideguard.

Advantages of the present invention are that a sideguard pad for use on a hospital bed sideguard is provided which is relatively simple and inexpensive to manufacture, which can be readily installed or removed as desired, which is readily disassembled for laundering, which doesn't inhibit access to hospital bed controls located on the sideguard and which is readily adaptable to any number of shapes and sizes of sideguards.

These and other objects and advantages of the present invention will become more readily apparent during the following detailed description taken in conjunction with the drawings herein, in which:

DESCRIPTION OF PREFERRED EMBODIMENTS

Figure 1:
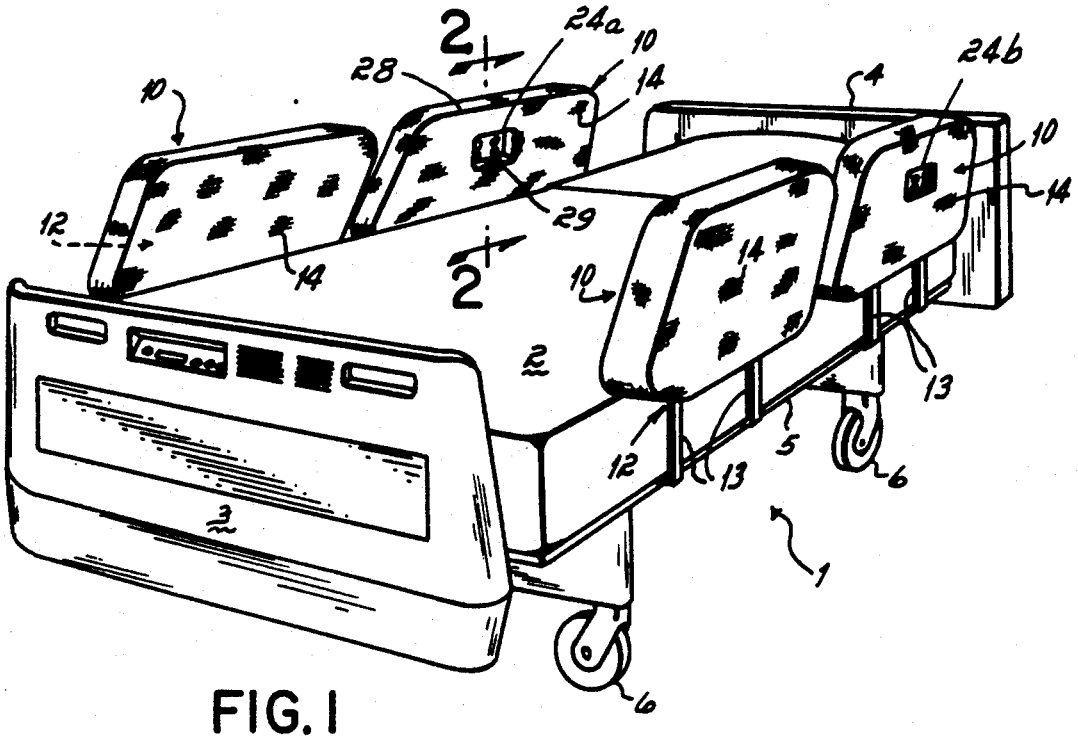
FIG. 1 is a perspective view of a hospital bed employing the sideguard pads of the present invention.

With reference first to FIG. 1, there is illustrated a hospital bed 1 having installed thereon the sideguard pads 10 of the present invention. The bed 1 is a conventional hospital bed having a mattress 2, footboard 3, headboard 4, supporting frame 5 and casters 6. Four sideguards 12 are mounted via posts 13 for articulation with respect to the frame 5 of the bed 1.

Figure 2:
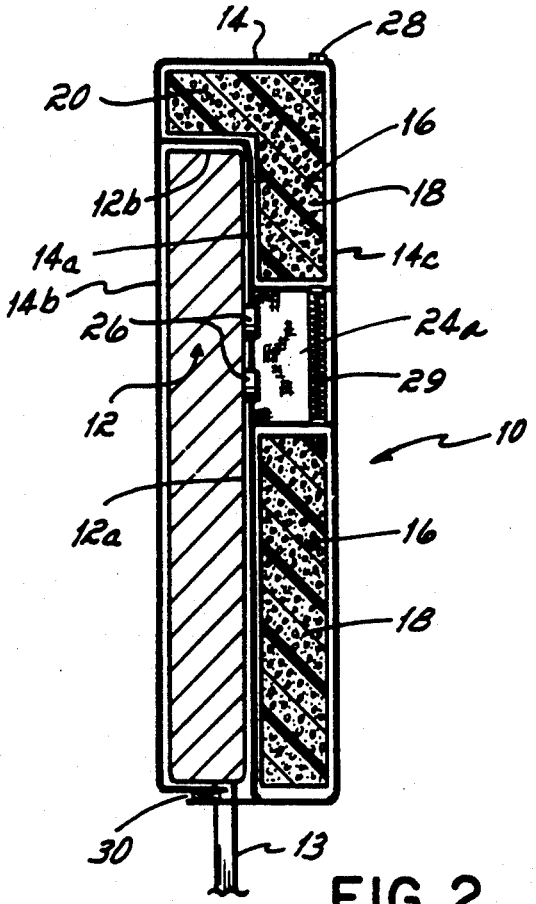
FIG. 2 is a schematic cross sectional view of a hospital bed sideguard with a sideguard pad of the present invention installed thereon as seen along line 2—2 of FIG. 1.

With reference to FIG. 2, one of the sideguard pads 10 is illustrated as being installed over one of the sideguards 12. The sideguard pad 10 comprises a slip cover 14, within which is disposed a foam pad 16. The slip cover 14 is fabricated of a durable moisture resistant fabric, and preferably fabricated of urethane coated nylon, or urethane coated polyester. The foam pad 16 is fabricated of relatively soft resilient foam, and preferably is fabricated of polyurethane foam, 3.3 density, 70 I.F.D.

The foam pad 16 includes a generally vertically disposed planar portion or slab 18 which substantially covers the inboard vertical plane 12*a* of the sideguard 12, and an upper lip 20 which overlies or covers the upper edge 12*b* of the sideguard 12. An aperture is provided at 24*a* for patient access to hospital bed controls 26 located on the inboard side of the sideguard 12 for manipulating the bed 1.

As can be seen from FIG. 2, slip cover 14 includes a first compartment defined by outboard 14*b* and central 14*a* fabric panels which encompasses sideguard 12. A separate second enclosure defined by the central fabric panel 14*a* and an inboard fabric panel 14*c* receives the pad 16.

To removably insert the pad 16 within the slip cover 14, zippers 28 and 29 are incorporated within the slip cover 14 along the top inboard edge of the pad 10 (having a length corresponding generally to the horizontal length of the top edge) and around the perimeter of the aperture 24*a*, respectively. In order to secure the sideguard pad 10 to the sideguard 12 after installing same thereon, fabric hook and loop type closures 30 are provided on the ends of the sideguard pad 10 and placed so as not to interfere with articulating posts 13, for example fore and aft of the posts 13. The closures 30 preferably take the form of Velcro® closures.

It will be appreciated that to allow access to hospital bed controls located on the outboard side of the sideguard, an aperture such as that shown at 24*b* (FIG. 1) can be provided which takes the form of a window in the outboard fabric panel 14*b* of slipcover 14, with no zipper being required.

As will be readily apparent from the figures, with the sideguard pad 10 installed upon a hospital bed sideguard 12, a patient lying atop the mattress 2 of bed 1 will be protected from bruises, contusions, and the like which could be inflicted upon the patient upon inadvertently rolling into and contacting the sideguard 12. The planar portion or slab 18 protects a patient from the planar portion 12*a* of a sideguard 12, while the upper lip 20 protects a patient from contacting the upper edge 12*b* of the sideguard 12 during patient ingress and egress from the bed when the sideguard is lowered. Zippers 28 and 29 facilitate insertion and removal of pad 10 within slipcover 14 for laundering the like, and apertures 24*a* and 24*b* allow patient and care provider access to hospital bed controls located on inboard and outboard sides of the sideguard, respectively.

Those skilled in the art will readily recognize numerous adaptations and modifications which can be made to the present invention and which will result in an improved hospital bed sideguard pad, yet all of which will fall within the spirit and scope of the present invention as defined by the following claims and their equivalents. Accordingly, the invention is to be limited only by the claims and their equivalents.

What is claimed is:

1. A sideguard pad for use in conjunction with a hospital bed having sideguards comprising:

a slipcover defining first and second compartments, said first compartment adapted to be placed over, around and secured to a hospital bed sideguard;

a foam pad disposed in said second compartment, said foam pad having a planar slab portion and an upper lip portion, said planar slab portion adapted to substantially cover an inboard vertical plane of the sideguard, said lip portion adapted to cover an upper edge of the sideguard;

means for selectively opening and closing said second compartment for facilitating removal and insertion of said foam pad into said second compartment of said slipcover; and means for securing said first compartment of said slipcover to the sideguard; said sideguard pad further including an aperture in at least one side of said sideguard pad for providing access to hospital bed controls mounted on the sideguard.

2. The sideguard pad of claim 1 wherein said means for selectively opening and closing said second compartment comprises a zipper in said slipcover along an upper edge of said sideguard pad.

3. The sideguard pad of claim 1 further comprising a zipper in said slipcover around the periphery of said aperture.

4. The sideguard pad of claim 1 wherein said securing means comprises a fabric hook and loop closure on a lower edge of said sideguard pad at each end thereof.

5. The sideguard pad of claim 1 wherein said slipcover is fabricated of urethane coated nylon or urethane coated polyester.

6. The sideguard pad of claim 1 wherein said foam pad is fabricated of polyurethane.

* * * * *